US006998523B1

(12) United States Patent
DeVuono

(10) Patent No.: US 6,998,523 B1
(45) Date of Patent: Feb. 14, 2006

(54) END PIN FOR A STRINGED MUSICAL INSTRUMENT OR OTHER ACOUSTIC DEVICE

(76) Inventor: Thomas J. DeVuono, 8413 Lacevine Pl., Louisville, KY (US) 40220

( * ) Notice: Subject to any disclaimer, the term of this patent is extended or adjusted under 35 U.S.C. 154(b) by 0 days.

(21) Appl. No.: 10/984,411

(22) Filed: Nov. 9, 2004

Related U.S. Application Data

(60) Provisional application No. 60/523,385, filed on Nov. 19, 2003.

(51) Int. Cl.
*G10D 3/12* (2006.01)

(52) U.S. Cl. ..... 84/280

(58) Field of Classification Search ..... 84/280, 84/290–302

See application file for complete search history.

(56) References Cited

U.S. PATENT DOCUMENTS

| | | | | |
|---|---|---|---|---|
| 2,974,556 | A | 3/1961 | Fawick | 84/280 |
| 4,018,129 | A | 4/1977 | Hollander | 84/294 |
| 4,037,505 | A * | 7/1977 | Maples | 84/280 |
| 6,696,626 | B1 | 2/2004 | Pagenkopf | 84/280 |

* cited by examiner

*Primary Examiner*—Kimberly Lockett
(74) *Attorney, Agent, or Firm*—Thomte, Mazour & Niebergall; Dennis L. Thomte

(57) ABSTRACT

An end pin for a stringed musical instrument such as a cello, bass or the like having an end pin receptacle at the base end thereof. A first or conical member is slidably mounted on an elongated rod and has a tapered upper end portion which is inserted into the end pin block or receptacle at the base of the instrument. A second or clamping member is threadably secured to the lower end of the first member and tightened thereon which causes a segmented collet portion on the first member to be moved into engagement with the rod to positively maintain the rod in selected longitudinal positions with respect to the instrument.

20 Claims, 3 Drawing Sheets

END PIN FOR A STRINGED MUSICAL INSTRUMENT OR OTHER ACOUSTIC DEVICE

CROSS-REFERENCE TO RELATED APPLICATION

This application claims the benefit of U.S. Provisional Application Ser. No. 60/523,385 entitled END PIN FOR CELLO OR OTHER ACOUSTIC DEVICE, filed Nov. 19, 2003, the disclosure of which is hereby incorporated herein by reference.

BACKGROUND OF THE INVENTION

1. Field of the Invention

This invention relates to an end pin for a stringed musical instrument such as a cello, bass or the like, as well as other acoustic devices such as speakers, amplifiers, and microphone stands.

2. Description of the Related Art

Stringed musical instruments such as a cello, bass or the like have an end pin receptacle or block at the base end thereof into which is inserted an end pin for supporting the instrument above a supporting surface such as a floor or the like. Many types of length adjustable end pins have been previously provided to enable the instrument to be properly positioned with respect to the person playing the same. It is believed that the prior art end pins are not easy to use or adjust and may detract from the acoustical performance of the instrument.

SUMMARY OF THE INVENTION

A length adjustable end pin for a stringed musical instrument such as a cello, bass or the like, as well as a support for other acoustic devices such as speakers, amplifiers, and microphone stands is described. The end pin (support) comprises an elongated rod having first and second ends with an end point threadably secured to the first end of the rod for engagement with a supporting surface. A first or conical member having first and second ends with a central bore formed therein, which extends between the ends thereof, has the rod selectively longitudinally slidably received therein. The first member has a tapered or frusto-conical shaped portion at its second end which is adapted to be received by the end pin receptacle. The first member also has a tapered and segmented collet portion at its first end. Further, the first member has external threads provided thereon. A second or clamping member is also provided which has first and second ends. The second member has a central bore, having first and second ends, formed therein which extends between the first and second ends thereof. The rod extends through the central bore of the second member. The second member has internal threads formed therein at the second end of the central bore thereof which are adapted to threadably receive the external threads of the first member. The central bore of the second member has a tapered portion between the internal threads and the first end thereof which engages the segmented collet portion as the second member is threadably secured to the first member to force the segmented collet portion into frictional gripping engagement with the rod to maintain the rod in a selected position with respect to the first member and the instrument or acoustic device. Preferably, the rod, first member, second member and end point are comprised of a brass material.

It is therefore a principal object of the invention to provide an improved end pin for a stringed musical instrument such as a cello, bass or the like.

Yet another object of the invention is to provide a support for an acoustic device such as speakers, amplifiers and microphone stands.

Yet another object of the invention is to provide an end pin of the type described which is quickly and easily adjusted to vary the operative length of the end pin.

Still another object of the invention is to provide an end pin of the type described which is formed from brass material to improve the acoustic performance of the instrument by way of increased efficiency of vibration transfer.

Still another object of the invention is to provide an end pin of the type described which securely maintains the end pin in its selected length.

These and other objects will be apparent to those skilled in the art.

DETAILED DESCRIPTION OF THE INVENTION

Figure 1:
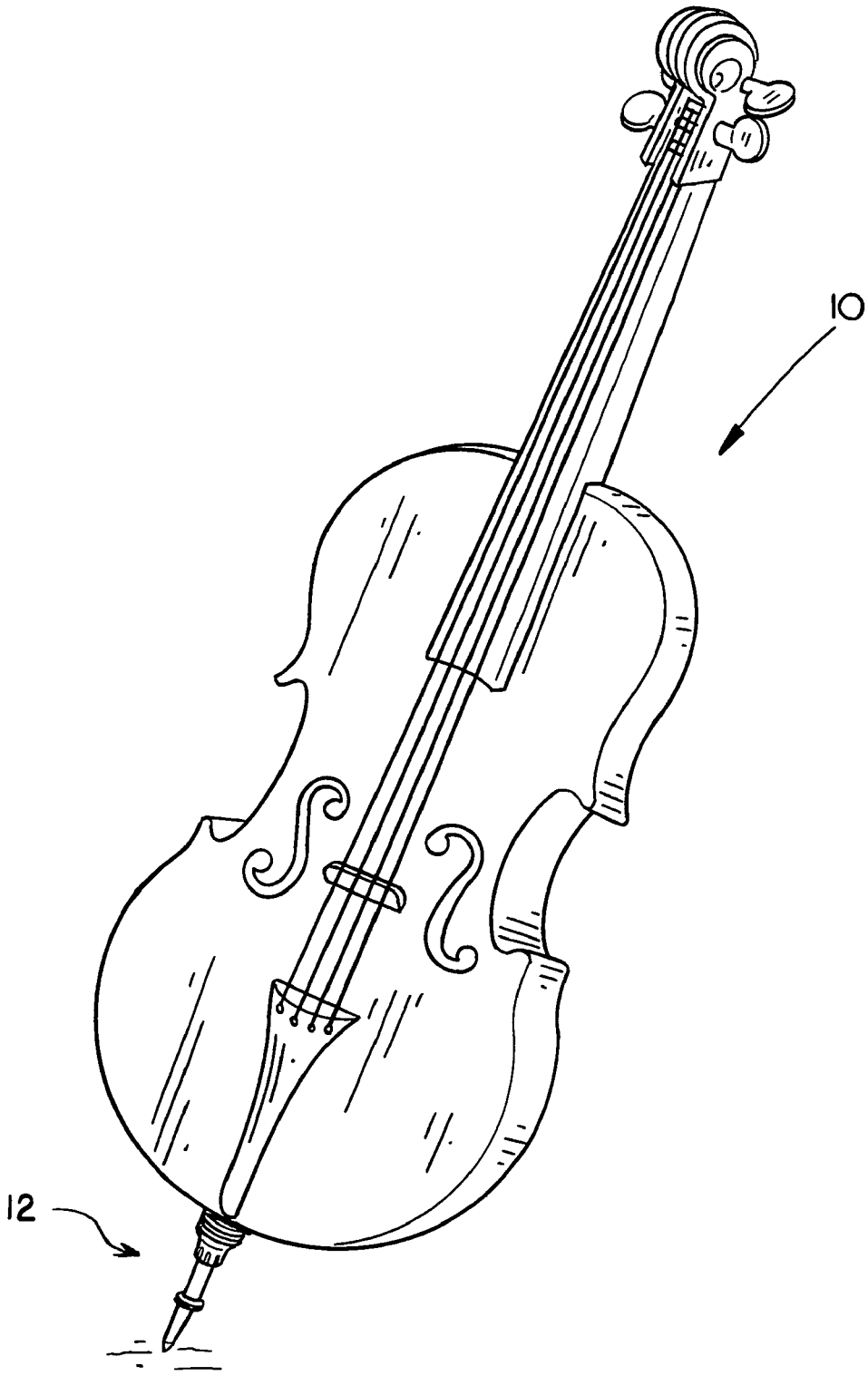
FIG. 1 is a perspective view of the end pin of this invention secured to the base end of a stringed musical instrument such as a cello.

Referring to the drawings, the numeral 10 illustrates a stringed musical instrument such as a cello. While a cello is illustrated in the drawings, the stringed musical instrument could be a bass or the like. Further, rather than a stringed musical instrument, the end pin of this invention could be used as a support or multiple supports for acoustic devices such as amplifiers, speakers, electronic keyboards, speaker stands and pianos. In that case, one or more of the supports would be secured to the acoustic device.

Figure 3:
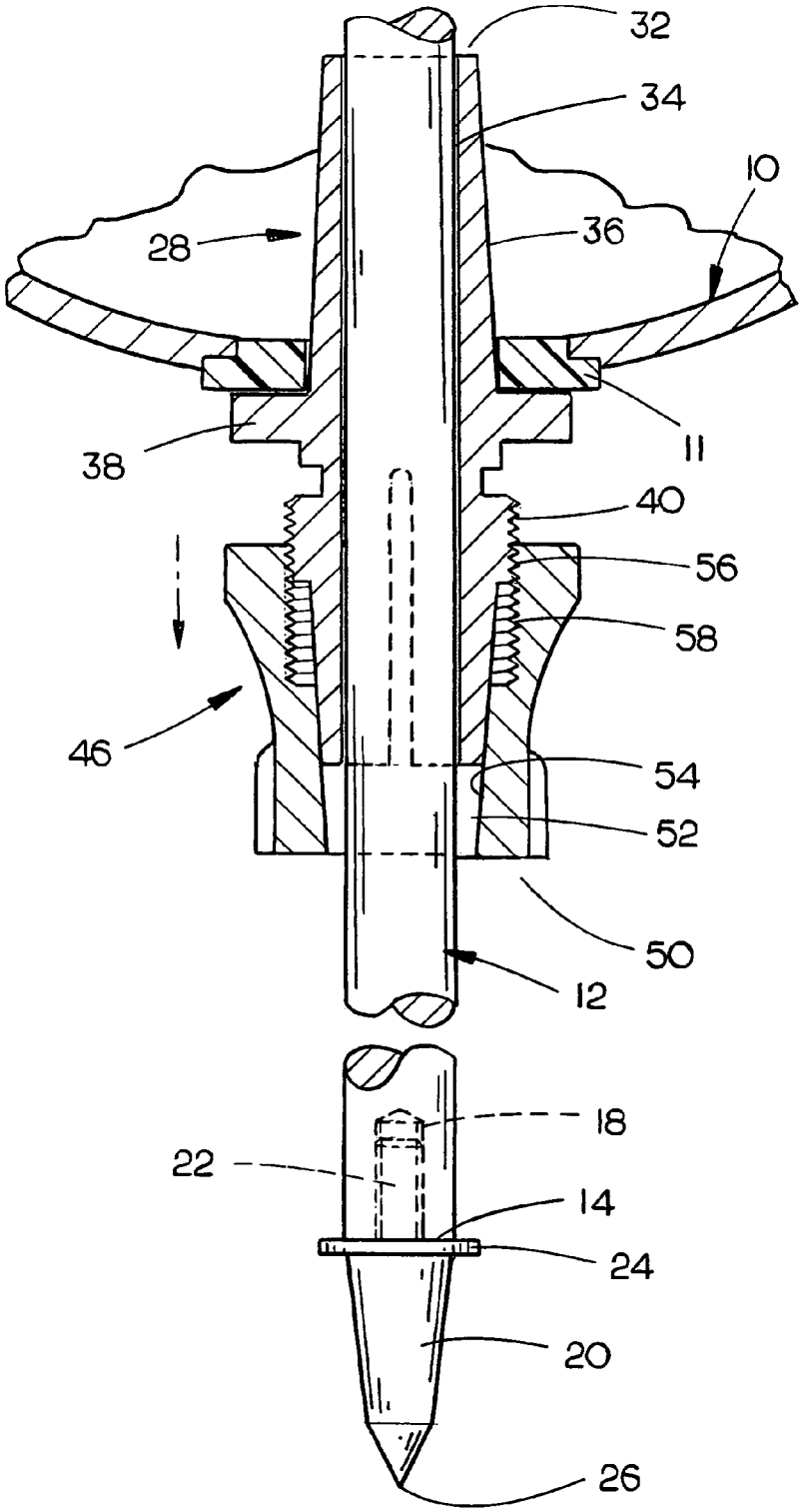
FIG. 3 is a partial sectional view illustrating the end pin of this invention mounted in the end pin block or receptacle of a stringed musical instrument.

The numeral 12 refers generally to the end pin of this invention. End pin 12 includes an elongated, solid brass rod which is preferably 18.5 inches long and has an outside diameter of 0.5 inch. For purposes of description, the rod 12 will be described as having a first or lower end 14 and a second or upper end 16. The lower end 14 of rod 12 is provided with an internally threaded bore 18, as illustrated in FIG. 3. The numeral 20 refers to an end point which has an externally threaded stud 22 extending from the upper end thereof which is threadably received by the threaded bore 18. End point 20 is also provided with an annular flange or shoulder 24 which engages the lower end 14 of rod 12. Preferably, the end point 20 has a pointed end 26 which is adapted to engage a supporting surface such as a floor or some type of holder. The end point or end tip can be easily replaced for reasons of wear and tear. Further, the end point can be replaced with different sizes and geometry to optimize size, fit, tone, etc.

The numeral refers 28 to a first or conical member which has a lower end 30 and an upper end 32. First member 28 is provided with an elongated central bore 34 extending between the ends thereof and which is adapted to slidably receive the rod 12 therein. Preferably, first member 28 is also comprised of a brass material. Member 28 is provided with a tapered or frusto-conical shaped portion 36 at its upper end 32. The tapered portion 36 is provided so that the upper end of the member 28 may be inserted into the end pin block or receptacle 11 and wedged therein. Member 28 is provided with an annular flange 38 at the lower end of the tapered portion 36 which may or may not engage the end pin block 11.

Member 28 is also provided with a segmented externally threaded portion 40 and a tapered collet portion 42 which is also segmented. The segmentation of the external threads 40 and the collet portion 42 is created by longitudinal slots or slits 44 formed therein.

The numeral 46 refers to a second or clamping member having first or lower and second or upper ends 48 and 50, respectively. Member 46 is also provided with a bore 52 extending therethrough which includes a tapered portion 54 and a non-tapered portion 56 at the upper end thereof. Internal threads 58 are formed in the member 46, as seen in FIG. 3, which are adapted to threadably receive the external threads 40 of member 28.

Figure 2:
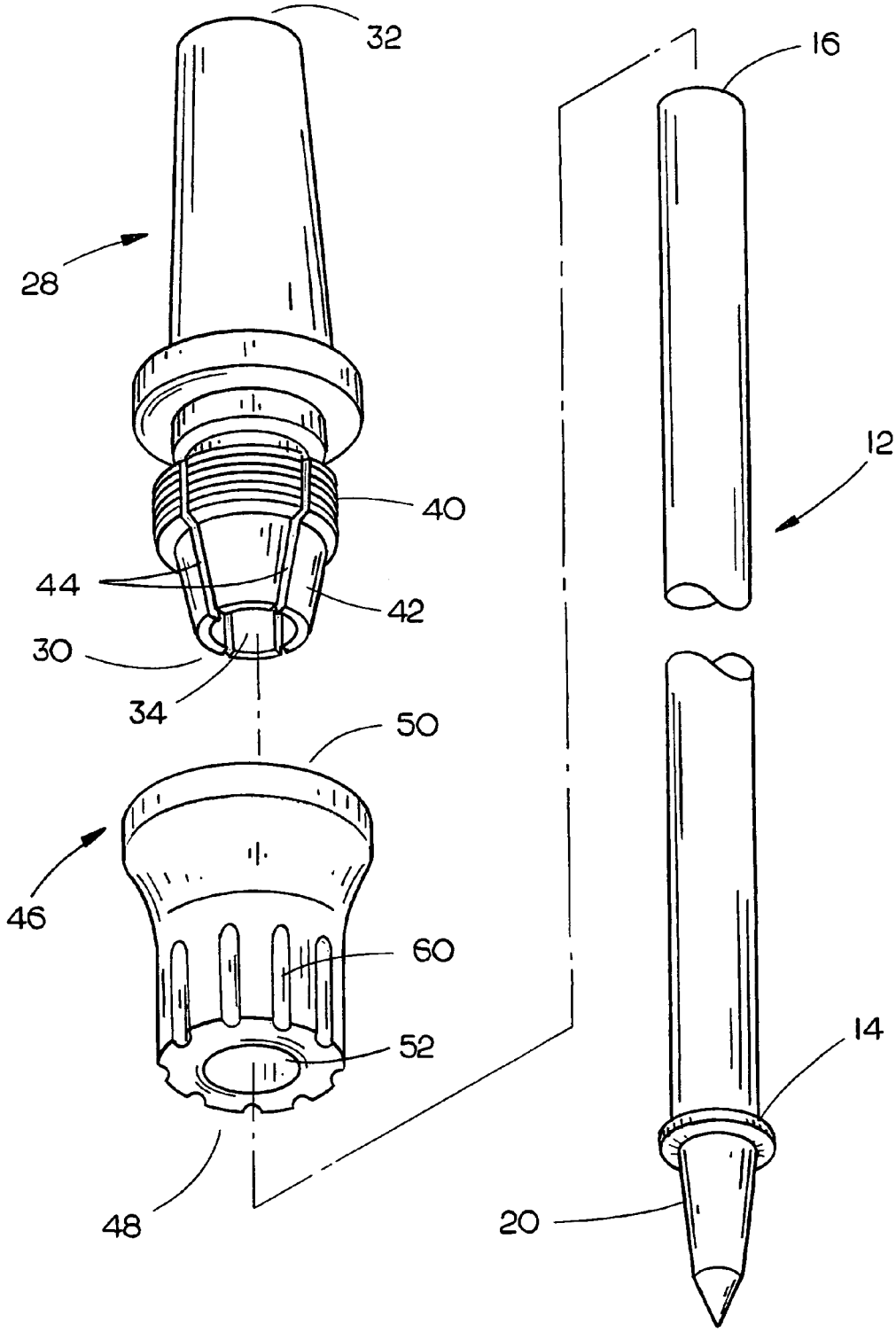
FIG. 2 is a partial exploded perspective view of the end pin of this invention.

The end pin of this invention is installed and used as follows. The member 46 is slipped over the upper end 16 of the rod 12, as illustrated by the broken lines in FIG. 2. The downward movement of the member 46 on the rod 12 is limited by the engagement of the lower end of the member 46 with the annular flange 14 on the end point 20. The member 28 is then slipped over the upper end of the rod 12, as also illustrated by the broken lines in FIG. 2. The tapered portion 36 of member 28 is then inserted upwardly into the end pin block 11 and wedged therein so that the member 28 is held in place at the base of the cello 10. It should be noted that the member 28, prior to being slipped over the rod 12, could be inserted into the end block 11 with the assembled rod 12 and member 46 then being secured to the member 28.

The length of the rod 12 is adjusted with respect to the member 28 so that the instrument or device is supported above the supporting surface at the desired position. When the rod 12 has been properly positioned with respect to member 28, member 46 is threadably tightened or rotated with respect to member 28 which causes the member 46 to move upwardly with respect to member 28 and the rod 12 which in turn causes the tapered surface 54 in bore 52 to deflect or force the segmented collet portion 42 into frictional gripping engagement with the exterior surface of the rod 12 to firmly position the rod 12 with respect to the member 28. The threadable attachment of the member 46 to the member 28 is enhanced due to the gripping surface 60 provided on the lower exterior portion thereof.

If it is necessary to adjust the length of the protruding portion of the rod 12 with respect to members 28 and 46, member 46 is threadably loosened with respect to member 28 so that the collet portion 42 moves out of frictional engagement with the rod 12. The rod 12 may then be moved upwardly or downwardly with respect to the member 28 to place the rod in its desired position. The member 46 is then again tightened onto the member 28 to firmly maintain the rod 12 in its desired position. If the instrument is not going to be used for some time or is going to be transported, the rod 12 may be inserted completely upwardly into the member 46 with the flange 24 limiting the amount of upward movement of the rod 12 with respect to the member 46.

The locking arrangement described above provides 360° contact between the members 28, 46 and rod 12 as well as contact for a substantial axial length. The extensive contact area and the fact that the members 12, 28 and 46 are made of the same material allow the end pin to resonate with the instrument, resulting in an arrangement that improves the acoustical properties of the instrument. The sound is substantially louder and tones can be heard that were not previously audible using a standard end pin. The dynamic range and frequency response of the instrument are improved, giving the instrument one sonic signature instead of multiple signatures as in prior art designs. The result is very dramatic.

While brass is the preferred composition of the components of the end pin of this invention, the components could be comprised of other materials with decreased sonic advantages. It is important to note that all the components should be comprised of the same material.

Thus it can be seen that the invention accomplishes at least all of its stated objectives.

I claim:

1. An end pin for a stringed musical instrument such as a cello, bass or the like having an end pin receptacle at the base thereof, comprising:

an elongated rod having lower and upper ends;

an end point secured to said lower end of said rod for engagement with a supporting surface;

a first member having lower and upper ends with a central bore formed therein which extends between said lower and upper ends thereof;

said rod being selectively longitudinally slidably received by said central bore of said first member;

said first member having a tapered portion at its said upper end which is adapted to be received by said end pin receptacle;

said first member having a tapered and segmented collet portion at its said lower end;

said first member having external threads provided thereon;

a second member having lower and upper ends;

said second member having a central bore, having first and second ends, formed therein which extends between said lower and upper ends of said second member;

said rod extending through said central bore of said second member;

said second member having internal threads formed therein at said upper end of said central bore thereof which are adapted to threadably receive said external threads of said first member;

said central bore of said second member having a tapered portion between said internal threads and said lower end thereof;

said tapered portion of said central bore of said second member engaging said segmented collet portion as said second member is threadably secured to said first member to force said segmented collet portion into frictional engagement with said rod to maintain said rod in a selected position with respect to said first member.

2. The end pin of claim 1 wherein said rod, first member, second member and said end point are comprised of a metal material.

3. The end pin of claim 1 wherein said rod, first member, second member and said end point are comprised of a brass material.

4. The end pin of claim 1 wherein said end point is threadably secured to said lower end of said rod.

5. The end pin of claim 1 wherein said lower end of said rod has an internally threaded bore formed therein, said end point having lower and upper ends, said upper end of said end point having a threaded stud extending therefrom which is threadably received by said internally threaded bore at said lower end of said rod.

6. The end pin of claim 5 wherein said lower end of said end point is pointed.

7. The end pin of claim 5 wherein said end point has a shoulder formed thereon for engagement with said lower end of said rod.

8. The end pin of claim 1 wherein said second member has a gripping portion formed thereon.

9. The end pin of claim 1 wherein said tapered portion of said first member has lower and upper ends and wherein said first member has an annular flange protruding therefrom at said lower end of said tapered portion thereof.

10. The end pin of claim 1 wherein said external threads of said first member are also segmented.

11. A support for an acoustic device having a receptacle at the base thereof, comprising:

an elongated rod having lower and upper ends;

an end point secured to said lower end of said rod for engagement with a supporting surface;

a first member having lower and upper ends with a central bore formed therein which extends between said first and second ends thereof;

said rod being selectively longitudinally slidably received by said central bore of said first member;

said first member having a tapered portion at its said upper end which is adapted to be received by said receptacle;

said first member having a tapered and segmented collet portion at its said lower end;

said first member having external threads provided thereon;

a second member having lower and upper ends;

said second member having a central bore, having first and second ends, formed therein which extends between said lower and upper ends of said second member;

said rod extending through said central bore of said second member;

said second member having internal threads formed therein at said upper end of said central bore thereof which are adapted to threadably receive said external threads of said first member;

said central bore of said second member having a tapered portion between said internal threads and said lower end thereof;

said tapered portion of said central bore of said second member engaging said segmented collet portion as said second member is threadably secured to said first member to force said segmented collet portion into frictional engagement with said rod to maintain said rod in a selected position with respect to said first member.

12. The end pin of claim 11 wherein said rod, first member, second member and said support are comprised of a metal material.

13. The end pin of claim 11 wherein said rod, first member, second member and said support are comprised of a brass material.

14. The support of claim 11 wherein said end point is threadably secured to said first end of said rod.

15. The support of claim 11 wherein said lower end of said rod has an internally threaded bore formed therein, said end point having lower and upper ends, said upper end of said end point having a threaded stud extending therefrom which is threadably received by said internally threaded bore at said lower end of said rod.

16. The support of claim 15 wherein said end point has a shoulder formed thereon for engagement with said lower end of said rod.

17. The support of claim 11 wherein said upper member has a gripping portion formed thereon.

18. The support of claim 11 wherein said tapered portion of said first member has lower and upper ends and wherein said first member has an annular flange protruding therefrom at said lower end of said tapered portion thereof.

19. The support of claim 11 wherein said external threads of said first member are also segmented.

20. An end pin, comprising:

an elongated rod;

a first member having an elongated central bore formed therein;

said first member having opposite ends;

said rod being selectively longitudinally received by said central bore of said first member;

said first member having a conical projection at one end thereof and a tapered and segmented collet at the other end thereof;

a clamping member having an elongated central bore;

said clamping member being threaded onto said collet to clamp said collet onto said rod.

* * * * *